US011514850B1

(12) United States Patent
Chang

(10) Patent No.: US 11,514,850 B1
(45) Date of Patent: Nov. 29, 2022

(54) DISPLAY DEVICE WHICH IMPROVES GHOST IMAGES AND RELATED DRIVING CIRCUIT AND METHOD

(71) Applicant: QISDA CORPORATION, Taoyuan (TW)

(72) Inventor: Chih-Ming Chang, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/697,960

(22) Filed: Mar. 18, 2022

(30) Foreign Application Priority Data

Jan. 29, 2022 (CN) ..... 202210110805.6

(51) Int. Cl.
*G09G 3/32* (2016.01)

(52) U.S. Cl.
CPC ..... *G09G 3/32* (2013.01); *G09G 2310/0297* (2013.01); *G09G 2310/08* (2013.01); *G09G 2320/0257* (2013.01)

(58) Field of Classification Search
CPC ..... G09G 3/32; G09G 2310/0297; G09G 2310/08; G09G 2320/0257
See application file for complete search history.

(56) References Cited

U.S. PATENT DOCUMENTS

2019/0204981 A1* 7/2019 Lee ..... G06F 3/04184
2019/0311681 A1* 10/2019 Dupont ..... G09G 3/2022
2020/0105185 A1* 4/2020 Chen ..... F21S 4/20
2020/0160807 A1* 5/2020 Tomie ..... G09G 3/3677
2020/0168172 A1* 5/2020 Sawahata ..... G09G 3/3611
2020/0193905 A1* 6/2020 Yoon ..... G09G 3/3291
2020/0211486 A1* 7/2020 Wang ..... G09G 3/3614
2020/0303468 A1* 9/2020 In ..... H01L 27/3276

* cited by examiner

*Primary Examiner* — Andrew Sasinowski

(57) ABSTRACT

A display device includes a luminescent array and a column driver. The cathodes of the first row of luminescent devices are coupled to a first word line. The anodes of the second row of luminescent devices are coupled to a second word line. In the $m^{th}$ column of luminescent devices, the anode of a first luminescent device in the first row is coupled to the cathode of a second luminescent device in the second row. The column driver includes a switch and two multiplexers. The switch controls the path between input signal and the $m^{th}$ column of luminescent devices. The first multiplexer provides a first driving signal for charging the parasite capacitor in the switch and the first luminescent device during a first period. The second multiplexer provides a second driving signal for charging the second luminescent device and discharging the parasite capacitor in the switch during a second period.

20 Claims, 7 Drawing Sheets

DISPLAY DEVICE WHICH IMPROVES GHOST IMAGES AND RELATED DRIVING CIRCUIT AND METHOD

BACKGROUND OF THE INVENTION

1. Field of the Invention

The present invention is related to a display device and related driving circuit and method, and more particularly, to a display device which improves ghost images and related driving circuit and method.

2. Description of the Prior Art

Compared to traditional incandescent bulbs, light-emitting diodes (LEDs) are advantageous in low power consumption, long lifetime, small size, no warm-up time, fast reaction speed, and the ability to be manufactured as small or array devices. In addition to outdoor displays, traffic signs, and liquid crystal display (LCD) for various electronic devices such as mobile phones, notebook computers or personal digital assistants (PDAs), LEDs are also widely used as indoor/outdoor lighting devices in place of fluorescent of incandescent lamps.

FIG. 1 is a diagram illustrating a prior art display device 10. The display device 10 includes a luminescent array 110, a row driver 120 and a column driver 130. The luminescent array 110 includes a plurality of luminescent devices $PX_{11}$-$PX_{NM}$ coupled to the row driver 120 via N rows of word lines $WL_1$-$WL_N$ and coupled to the column driver 130 via M columns of bit lines $BL_1$-$BL_M$. The luminescent devices $PX_{11}$-$PX_{NM}$ may be LEDs arranged in a common-cathode layout in which the cathodes of the same row of luminescent devices are coupled to the same word line.

The row driver 120 includes a plurality of select switches $SR_1$-$SR_N$ which are configured to conduct or cut off the signal transmission paths between the driving voltage VBB and the word lines $WL_1$-$WL_N$ based on the control signals $GR_1$-$GR_N$, wherein the driving voltage VBB is periodically supplied to each word line and only one word line is driven by the supply voltage VBB at the same time. The column driver 130 includes a plurality of select switches $SC_1$-$SC_M$ which are configured to conduct or cut off the signal transmission paths between the current sources $IS_1$-$IS_M$ and the bit lines $BL_1$-$BL_M$ based on the control signals $GC_1$-$GC_M$, thereby lighting up corresponding luminescent devices.

Due to the layout of metal lines, there exist parasite capacitors in the row diver 120 and the column driver 130, which causes ghost images in the multi-column scan driving scheme. For example, during the driving period of the word line $WL_1$, the select switch $SR_1$ is turned on, and the select switches $SC_1$-$SC_M$ are sequentially turned on and off for lighting up the luminescent devices $PX_{11}$-$PX_{1M}$, during which the residue charges in the parasite capacitors in the select switches $SC_1$-$SC_M$ may charge the luminescent devices and lighting up the wrong luminescent devices. Such ghost images may downgrade the quality of the display device 10.

SUMMARY OF THE INVENTION

The present invention provides a display device which improves ghost images and includes a column driver and a luminescent array having M columns and N rows of luminescent devices. Among an $n^{th}$ row of luminescent devices in the N rows of luminescent devices, a cathode of each luminescent device is coupled to an $n^{th}$ word line. Among an $(n+1)^{th}$ row of luminescent devices in the N rows of luminescent devices, an anode of each luminescent device is coupled to an $(n+1)^{th}$ word line. Among an $m^{th}$ column of luminescent devices in the M columns of luminescent devices, an anode of a first luminescent device located on the $n^{th}$ row is coupled to a cathode of a second luminescent device located on the $(n+1)^{th}$ row. M and N are integers larger than 1, m is an integer between 1 and M, and n is an integer between 1 and N. The column driver includes M select switches, a first multiplexer and a second multiplexer. The M select switches are configured to control signal transmission paths between an input signal and the M columns of luminescent devices, wherein an $m^{th}$ select switch among the M select switches is configured to control a signal transmission path between the input signal and the $m^{th}$ column of luminescent devices. The first multiplexer is configured to provide a first driving signal according to a first address signal for supplying power to a parasite capacitor in the $m^{th}$ select switch and the first luminescent device during a first driving period. The second multiplexer is configured to provide a second driving signal according to a second address signal for supplying power to the second luminescent device and discharging the parasite capacitor in the $m^{th}$ select switch during a second diving period subsequent to the first driving period.

The present invention also provides a driving method of improving ghost images. The driving method includes a first multiplexer in a display device outputting a first driving signal having a first voltage level based on a first address signal, turning on a select switch for transmitting the first driving signal to an anode of a first luminescent device in the display device, and a second multiplexer in the display device outputting a second driving signal having a second voltage level to a cathode of the first luminescent device based on a second address signal during a first driving period; the second multiplexer outputting the second driving signal having the first voltage level to an anode of a second luminescent device in the display device based on the second address signal, the first multiplexer outputting the first driving signal having the second voltage level based on the first address signal, and turning on the select switch for transmitting the first driving signal to a cathode of the second luminescent device during a second driving period subsequent to the first driving period. The first voltage level is higher than the second voltage level. The display device further includes M columns and N rows of luminescent devices arranged in a luminescent array. Among an $n^{th}$ row of luminescent devices in the N rows of luminescent devices, a cathode of each luminescent device is coupled to an $n^{th}$ word line. Among an $(n+1)^{th}$ row of luminescent devices in the N rows of luminescent devices, an anode of each luminescent device is coupled to an $(n+1)^{th}$ word line. The first luminescent device is located on an $m^{th}$ column and the $n^{th}$ row among of the M columns and N rows of luminescent devices. The second luminescent device is located on the $m^{th}$ column and an $(n+1)^{th}$ row among of the M columns and N rows of luminescent devices. An anode of the first luminescent device is coupled to a cathode of the second luminescent device. M and N are integers larger than 1, m is an integer between 1 and M, and n is an integer between 1 and N.

The present invention also provides a driving circuit which improves ghost images when driving M columns and N rows of luminescent devices. Among an $n^{th}$ row of luminescent devices in the N rows of luminescent devices, a cathode of each luminescent device is coupled to an $n^{th}$ word line. Among an $(n+1)^{th}$ row of luminescent devices in the N rows of luminescent devices, an anode of each luminescent device is coupled to an $(n+1)^{th}$ word line. Among an $m^{th}$ column of luminescent devices in the M columns of luminescent devices, an anode of a first luminescent device located on the $n^{th}$ row is coupled to a cathode of a second luminescent device located on the $(n+1)^{th}$ row. M and N are integers larger than 1, m is an integer between 1 and M, and n is an integer between 1 and N. The driving circuit includes a column driver which includes M select switches, a first multiplexer and a second multiplexer. The M select switches are configured to control signal transmission paths between an input signal and the M columns of luminescent devices, wherein an $m^{th}$ select switch among the M select switches is configured to control a signal transmission path between the input signal and the $m^{th}$ column of luminescent devices. The first multiplexer is configured to provide a first driving signal according to a first address signal for supplying power to a parasite capacitor in the $m^{th}$ select switch and the first luminescent device during a first driving period. The second multiplexer is configured to provide a second driving signal according to a second address signal for supplying power to the second luminescent device and discharging the parasite capacitor in the $m^{th}$ select switch during a second diving period subsequent to the first driving period.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
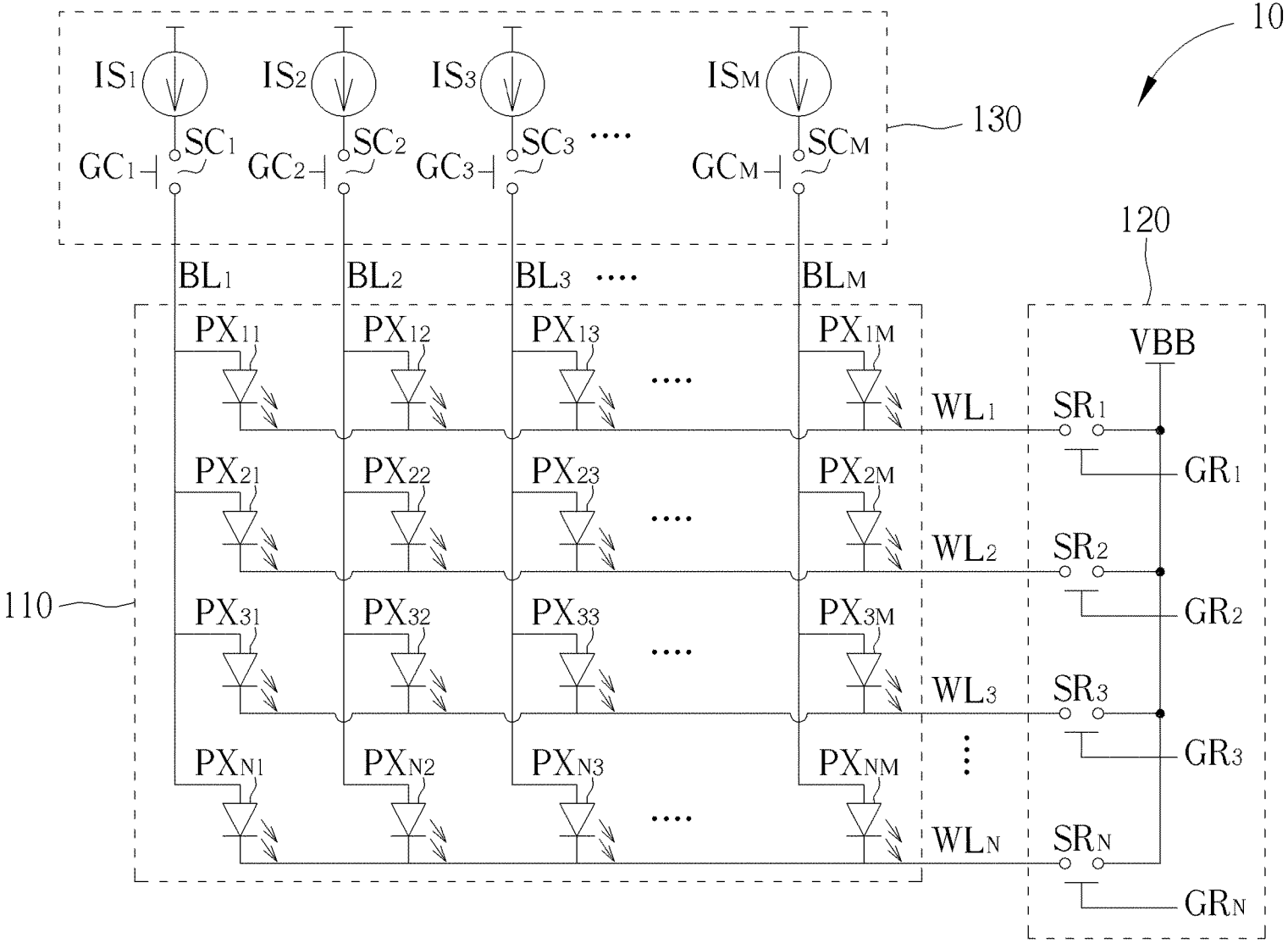
FIG. 1 PRIOR ART
FIG. 1 is a diagram illustrating a prior art display device.
Figure 2:
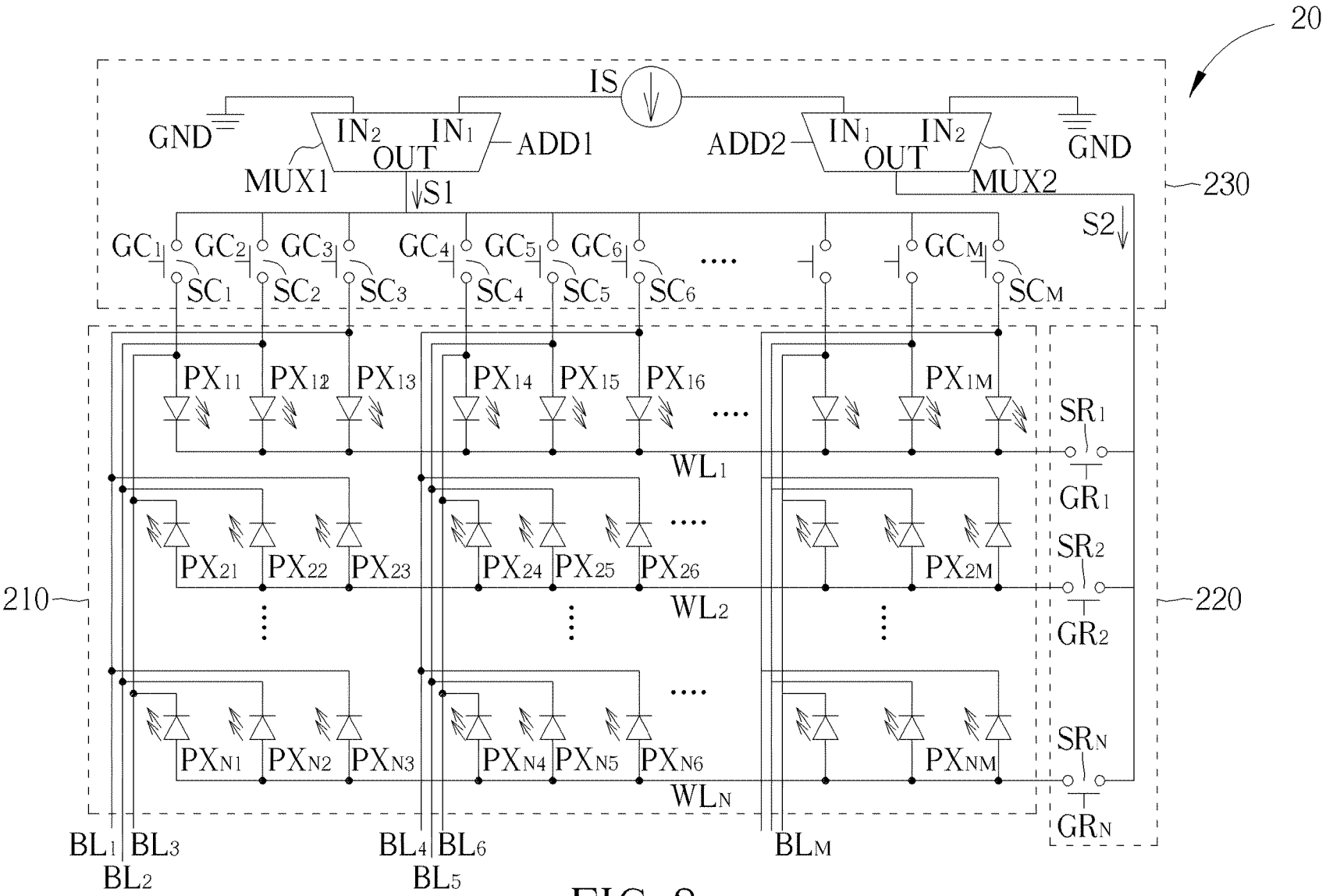
FIG. 2 is a diagram illustrating a display device which improves ghost image according to an embodiment of the present invention.

FIG. 2 is a diagram illustrating a display device 20 which improves ghost image according to an embodiment of the present invention. The display device 20 includes a luminescent array 210, a row driver 220 and a column driver 230. The luminescent array 210 includes M columns of luminescent devices and N rows of luminescent devices coupled to the row driver 220 via N word lines $WL_1$-$WL_N$ and coupled to the column driver 230 via M bit lines $BL_1$-$BL_M$, wherein M and N are integers larger than 1. In an embodiment, M is a multiple of 3, wherein the luminescent devices $PX_{11}$-$PX_{N1}$ located on the $1^{st}$ column are read luminescent devices, the luminescent devices $PX_{12}$-$PX_{N2}$ located on the $2^{nd}$ column are green luminescent devices, the luminescent devices $PX_{13}$-$PX_{N3}$ located on the $3^{rd}$ column are blue luminescent devices, and so on and so forth. In an embodiment, the luminescent devices $PX_{11}$-$PX_{NM}$ include LEDs, mini LEDs, micro LEDs, or any combination thereof. However, the quantity, the type and the layout of the luminescent devices in the luminescent array 10 do not limit the scope of the present invention.

Among the $1^{st}$ to the $N^{th}$ rows of luminescent devices of the luminescent array 210, the anodes of the luminescent devices on the odd-numbered rows are coupled to corresponding bit lines among the bit lines $BL_1$-$BL_M$, the cathodes of the luminescent devices on the odd-numbered rows are coupled together, the anodes of the luminescent devices on the even-numbered rows are coupled to corresponding bit lines among the bit lines $BL_1$-$BL_M$, and the anodes of the luminescent devices on the even-numbered rows are coupled together. For example, the anodes of the luminescent devices $PX_{11}$-$PX_{1M}$ on the $1^{st}$ row are respectively coupled to the bit lines $BL_1$-$BL_M$, the cathodes of the luminescent devices $PX_{11}$-$PX_{1M}$ on the $1^{st}$ row are coupled together, the anodes of the luminescent devices $PX_{21}$-$PX_{2M}$ on the $2^{nd}$ row are respectively coupled to the bit lines $BL_1$-$BL_M$, and the cathodes of the luminescent devices $PX_{21}$-$PX_{2M}$ on the $2^{nd}$ row are coupled together.

Among the $1^{st}$ to the $M^{th}$ luminescent devices of the luminescent array 210, the anodes of the luminescent devices on the odd-numbered rows are coupled to the cathodes of the luminescent devices on the adjacent even-numbered rows. For example, among the luminescent devices $PX_{11}$-$PX_{N1}$ on the $1^{st}$ column, the anode of the luminescent device $PX_{11}$ on the $1^{st}$ row is coupled to the cathode of the luminescent device $PX_{12}$ on the $2^{nd}$ row.

In the display device 20 of the present invention, the row driver 220 includes a plurality of select switches $SR_1$-$SR_N$, and the column driver 230 includes a current source IS, two multiplexers MUX1 and MUX2, and a plurality of select switches $SC_1$-$SC_M$. The multiplexer MUX1 includes a first input end $IN_1$ coupled to the current source IS, a second input end $IN_2$ coupled to a ground voltage GND, a control end coupled to a first address signal ADD1, and an output end for outputting a first driving signal S1. The multiplexer MUX2 includes a first input end $IN_1$ coupled to the current source IS, a second input end $IN_2$ coupled to the ground voltage GND, a control end coupled to a second address signal ADD2, and an output end for outputting a second driving signal S2. The multiplexer MUX1 is configured to selectively couple its first end $IN_1$ or its second input end $IN_2$ to its output end OUT based on the first address signal ADD1, thereby providing the input signal supplied by the current source IS or the ground voltage GND as the first driving signal S1. The multiplexer MUX2 is configured to selectively couple its first end $IN_1$ or its second input end $IN_2$ to its output end OUT based on the second address signal ADD2, thereby providing the input signal supplied by the current source IS or the ground voltage GND as the second driving signal S2.

The select switches $SC_1$-$SC_M$ includes first ends coupled to the output end OUT of the multiplexer MUX1, second ends respectively coupled to the $1^{st}$ to the $M^{th}$ columns of luminescent devices, and control ends respectively coupled to control signals $GC_1$-$GC_M$. The select switches $SR_1$-$SR_M$ includes first ends coupled to the output end OUT of the multiplexer MUX2, second ends respectively coupled to the word lines $WL_1$-$WL_N$, and control ends respectively coupled to control signals $GR_1$-$GR_M$. In the present invention, the select switches $SC_1$-$SC_M$ are configured to control the signal transmission paths between the first driving signal S1 and the M columns of luminescent devices respectively based on the control signals $GC_1$-$GC_M$, and the select switches $SR_1$-$SR_M$ are configured to control the signal transmission paths between the second driving signal S2 and the N rows of luminescent devices respectively based on the control signals $GR_1$-$GR_M$.

Figure 3:
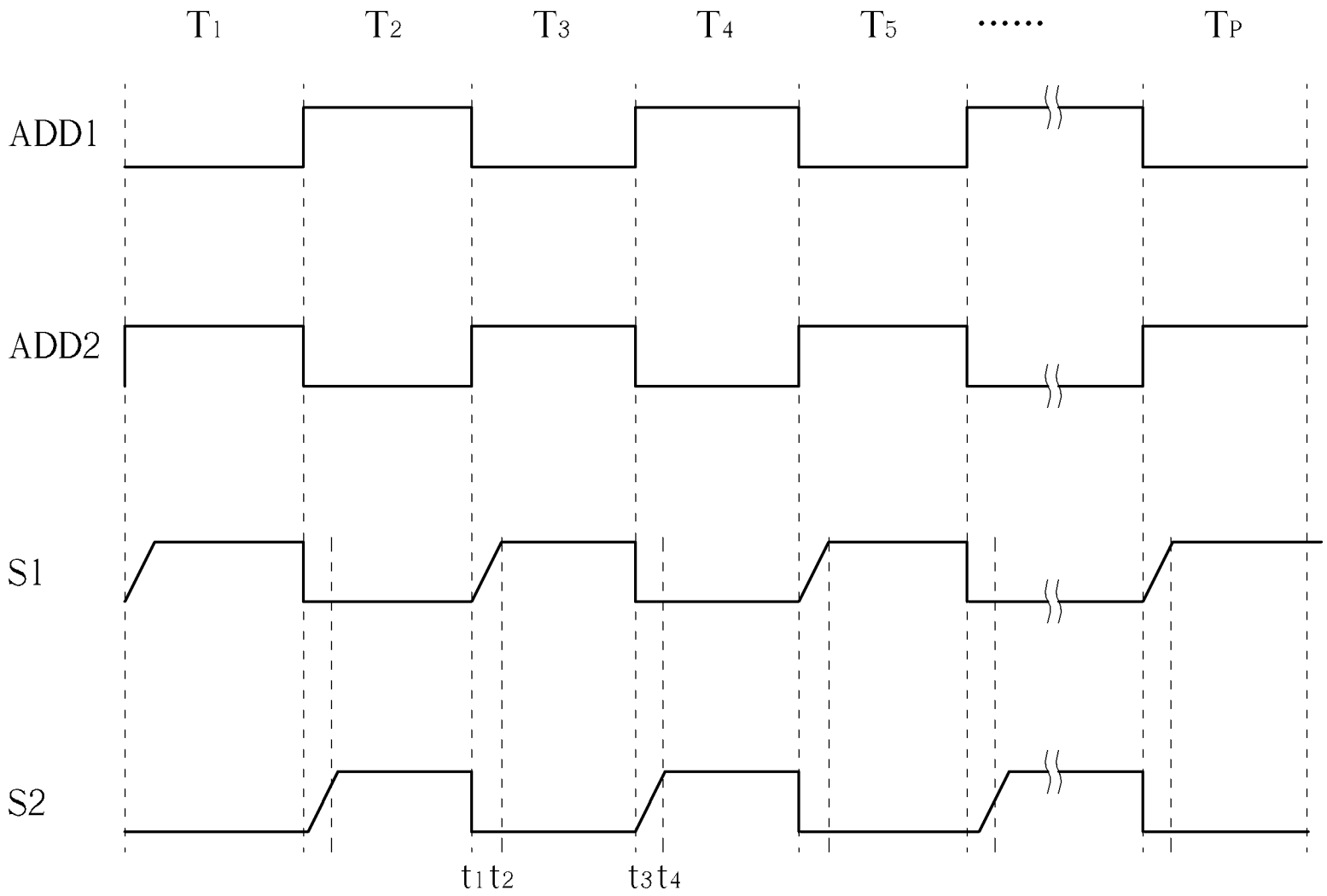
FIG. 3 is a diagram illustrating the waveforms of related signals during the operation of the display device according to an embodiment of the present invention.

FIG. 3 is a diagram illustrating the waveforms of related signals during the operation of the display device 20 according to an embodiment of the present invention. FIG. 3 depicts the waveforms of the first address signal ADD1, the second address signal S2, the first driving signal S1 and the second address signal S2, wherein $T_1$-$T_P$ represent the driving periods (P is an integer larger than 1). In the present invention, the first address signal ADD1 and the second address signal S2 periodically switch between a first voltage level (such as a high voltage level) and a second voltage level (such as a low voltage level), wherein the first address signal ADD1 and the second address signal S2 are at different voltage levels (having opposite phases) during the same period. More specifically, when the first address signal ADD1 or the second address signal S2 is at the second voltage level (such as a low voltage level), the multiplexer MUX1 or the second multiplexer MUX2 is configured to couple its first end $IN_1$ to its output end OUT so that the first driving signal S1 or the second driving signal S2 may be supplied by the current source IS (at a high voltage level); when the first address signal ADD1 or the second address signal S2 is at the first voltage level (such as a high voltage level), the multiplexer MUX1 or the second multiplexer MUX2 is configured to couple its second end $IN_2$ to its output end OUT so that the first driving signal S1 or the second driving signal S2 may be supplied by the ground voltage GND (at a low voltage level).

As depicted in FIG. 3, during the odd-numbered driving periods when the first address signal ADD1 is at a low voltage level and the second address signal S2 is at a high voltage level, the first driving signal S1 outputted by the multiplexer MUX1 is a high-level signal supplied by the current source IS, and the second driving signal S2 outputted by the multiplexer MUX2 is a low-level signal supplied by the ground voltage GND; during the even-numbered driving periods when the first address signal ADD1 is at a high voltage level and the second address signal S2 is at a low voltage level, the first driving signal S1 outputted by the multiplexer MUX1 is a low-level signal supplied by the ground voltage GND, and the second driving signal S2 outputted by the multiplexer MUX2 is a high-level signal supplied by the current source IS.

Figure 4A:
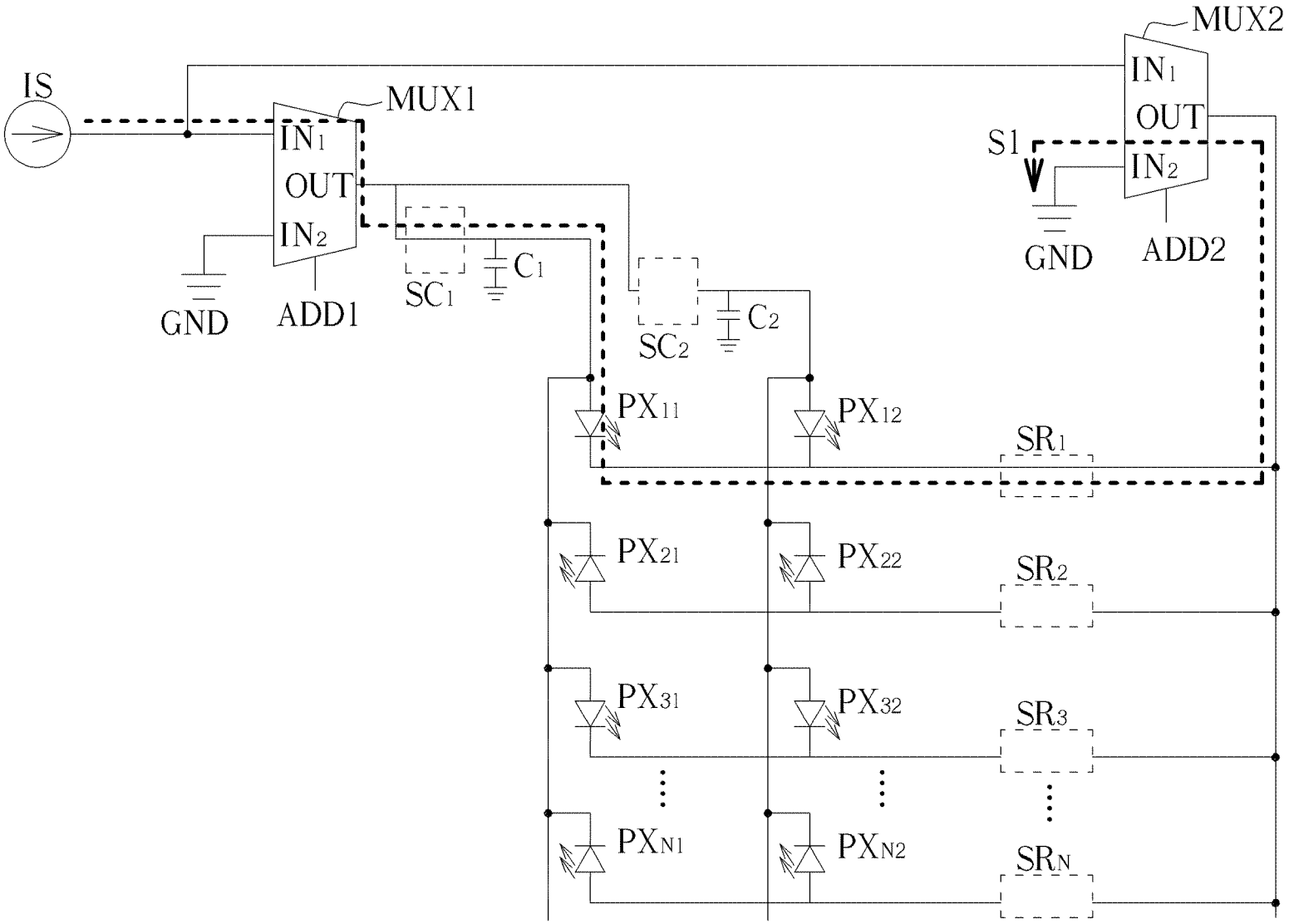
FIG. 4A is a diagram illustrating the operation of the display device according to an embodiment of the present invention.
Figure 4B:
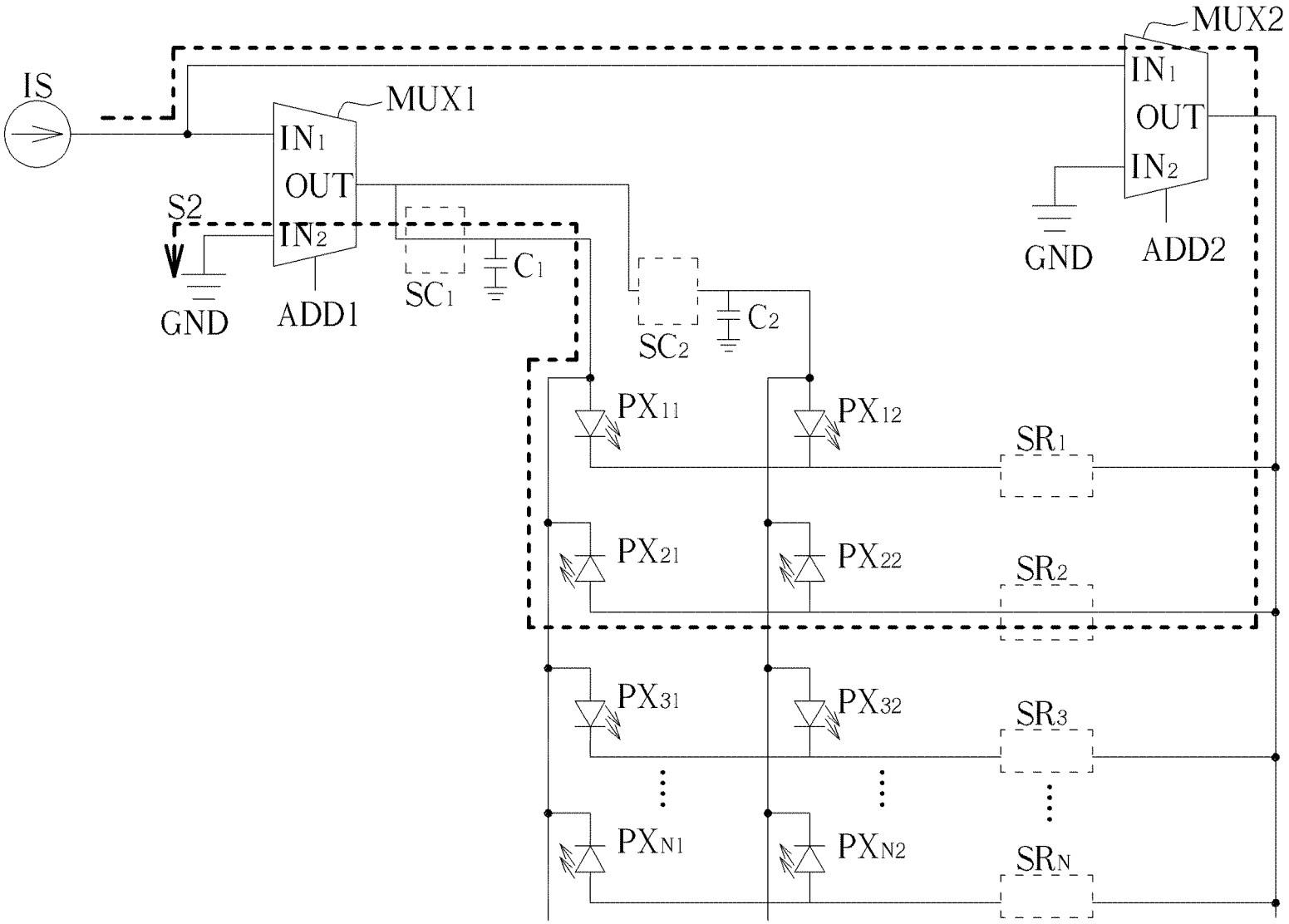
FIG. 4B is a diagram illustrating the operation of the display device according to an embodiment of the present invention.
Figure 4C:
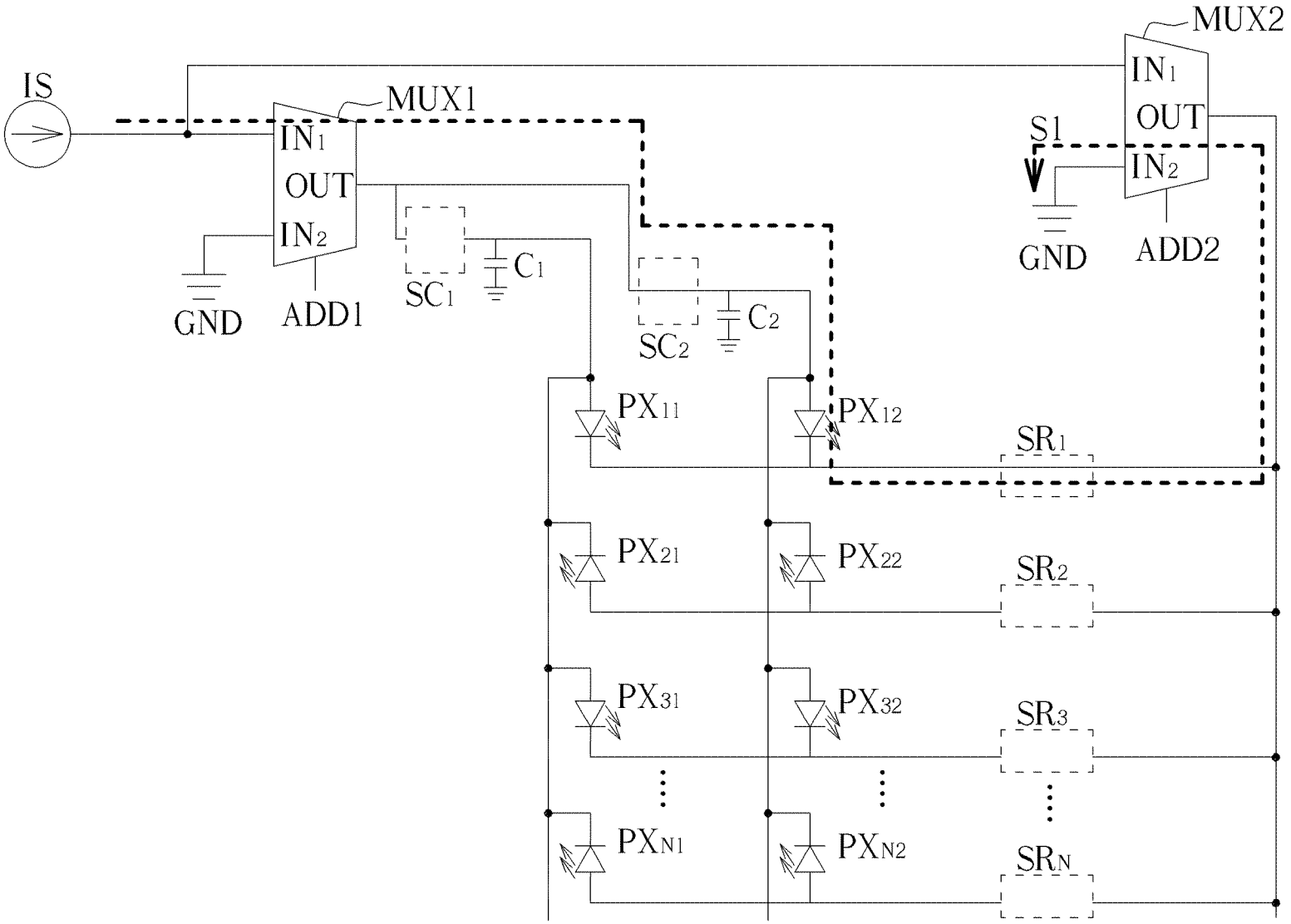
FIG. 4C is a diagram illustrating the operation of the display device according to an embodiment of the present invention.

FIGS. 4A-4D are diagrams illustrating the operation of the display device 20 according to embodiments of the present invention. For illustrative purpose, FIGS. 4A-4D only show the structure associated with the $1^{st}$ and the $2^{nd}$ columns of luminescent devices, wherein FIG. 4A depicts the operation of the display device 20 during the period $T_1$, FIG. 4B depicts the operation of the display device 20 during the period $T_2$, FIG. 4C depicts the operation of the display device 20 during the period $T_3$, and FIG. 4A depicts the operation of the display device 20 during the period $T_4$.

As depicted in FIGS. 3 and 4A, the output end OUT of the multiplexer MUX1 is coupled to the current source IS via its first input end $IN_1$, and the output end OUT of the multiplexer MUX2 is coupled to the ground voltage GND via its second input end $IN_2$ during the period $T_1$. Under such circumstances, the select switch $SC_1$ is turned on by the control signal $GC_1$ having an enable level, the select switch $SC_2$ is turned off by the control signal $GC_2$ having a disable level, the select switch $SR_1$ is turned on by the control signal $GR_1$ having an enable level, and the select switch $SR_2$-$SR_N$ are turned off by the control signals $GR_2$-$GR_N$ each having a disable level. Therefore, the first driving signal S1 having a high voltage level may flow from the output end OUT of the multiplexer MUX1 to the ground voltage GND via the turned-on select switches $SC_1$ and $SR_1$, the output end OUT of the multiplexer MUX2 and the second input end $IN_2$ of the multiplexer MUX2, thereby supplying power to (e.g., charging) the parasite capacitor $C_1$ in the select switch $SC_1$, as indicated by the arrow marks in FIG. 4A.

As depicted in FIGS. 3 and 4B, the output end OUT of the multiplexer MUX1 is coupled to the ground voltage GND via its second input end $IN_2$, and the output end OUT of the multiplexer MUX2 is coupled to the current source IS via its first input end $IN_1$ during the period $T_2$. Under such circumstances, the select switch $SC_1$ is turned on by the control signal $GC_1$ having an enable level, the select switch $SC_2$ is turned off by the control signal $GC_2$ having a disable level, the select switch $SR_2$ is turned on by the control signal $GR_2$ having an enable level, and the select switches $SR_1$ and $SR_3$-$SR_N$ are turned off by the control signals $GR_1$ and $GR_3$-$GR_N$ each having a disable level. Therefore, the second driving signal S2 having a high voltage level may flow from the output end OUT of the multiplexer MUX2 to the ground voltage GND via the turned-on select switches $SR_2$ and $SC_1$, the output end OUT of the multiplexer MUX1 and the second input end $IN_2$ of the multiplexer MUX1, thereby lighting up the luminescent device $PX_{21}$ and discharging the parasite capacitor $C_1$ in the select switch $SC_1$, as indicated by the arrow marks in FIG. 4B.

As depicted in FIGS. 3 and 4C, the output end OUT of the multiplexer MUX1 is coupled to the current source IS via its first input end $IN_1$, and the output end OUT of the multiplexer MUX2 is coupled to the ground voltage GND via its second input end $IN_2$ during the period $T_3$. Under such circumstances, the select switch $SC_1$ is turned off by the control signal $GC_1$ having a disable level, the select switch $SC_2$ is turned on by the control signal $GC_2$ having an enable level, the select switch $SR_1$ is turned on by the control signal $GR_1$ having an enable level, and the select switch $SR_2$-$SR_N$ are turned off by the control signals $GR_2$-$GR_N$ each having a disable level. Therefore, the first driving signal S1 having a high voltage level may flow from the output end OUT of the multiplexer MUX1 to the ground voltage GND via the turned-on select switches $SC_2$ and $SR_1$, the output end OUT of the multiplexer MUX2 and the second input end $IN_2$ of the multiplexer MUX2, thereby supplying power to the parasite capacitor $C_2$ in the select switch $SC_2$, as indicated by the arrow marks in FIG. 4C. Since the parasite capacitor $C_1$ in the select switch $SC_1$ has been discharged by the second driving signal S2 during the period $T_2$, there is no residual charge in the turned-off select switch $SC_1$ that causes ghost images.

Figure 4D:
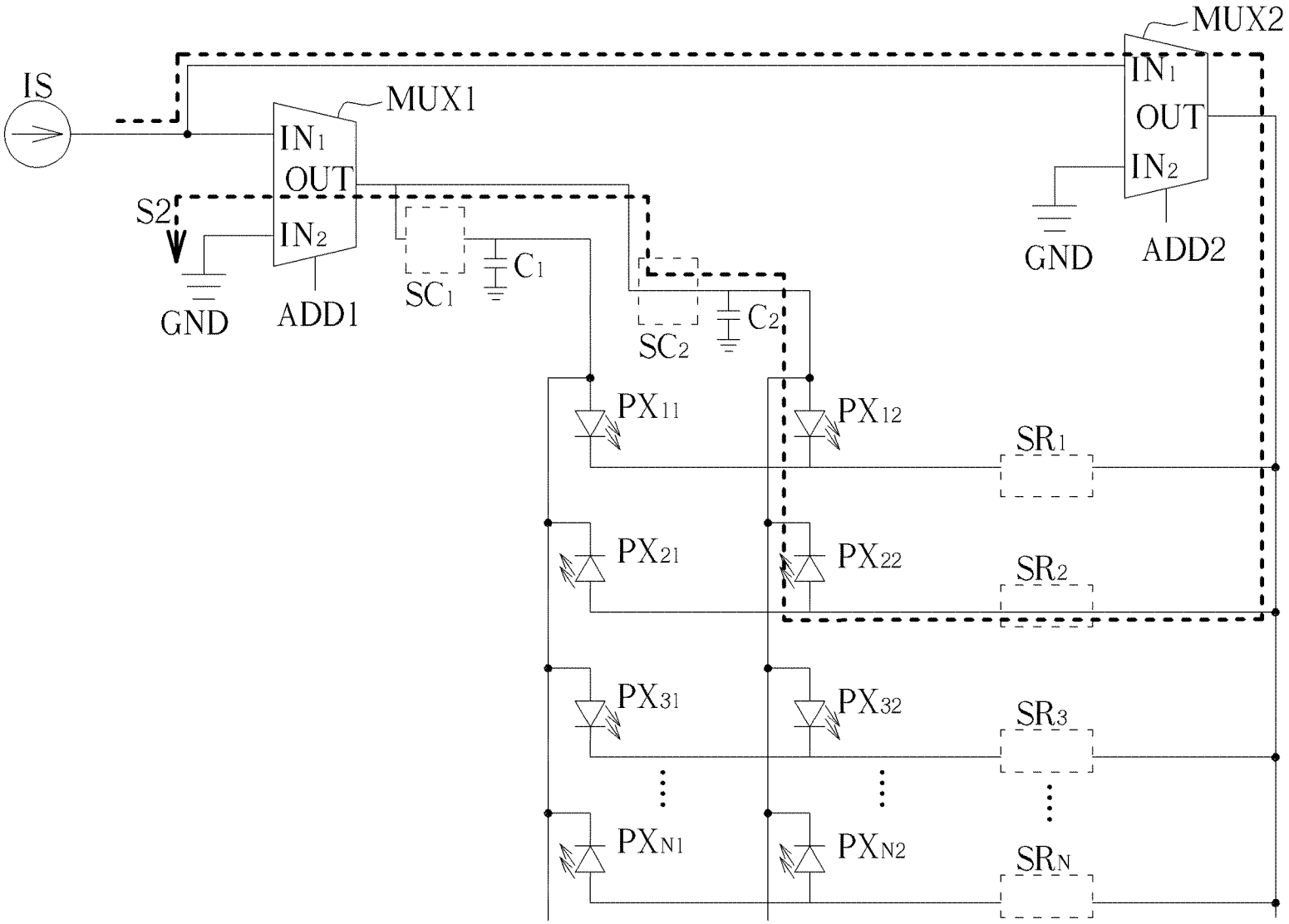
FIG. 4D is a diagram illustrating the operation of the display device according to an embodiment of the present invention.

As depicted in FIGS. 3 and 4D, the output end OUT of the multiplexer MUX1 is coupled to the ground voltage GND via its second input end $IN_2$, and the output end OUT of the multiplexer MUX2 is coupled to the current source IS via its first input end $IN_1$ during the period $T_4$. Under such circumstances, the select switch $SC_1$ is turned off by the control signal $GC_1$ having a disable level, the select switch $SC_2$ is turned on by the control signal $GC_2$ having an enable level, the select switch $SR_2$ is turned on by the control signal $GR_2$ having an enable level, and the select switches $SR_1$ and $SR_3$-$SR_N$ are turned off by the control signals $GR_1$ and $GR_3$-$GR_N$ each having a disable level. Therefore, the second driving signal S2 having a high voltage level may flow from the output end OUT of the multiplexer MUX2 to the ground voltage GND via the turned-on select switches $SR_2$ and $SC_2$, the output end OUT of the multiplexer MUX1 and the second input end $IN_2$ of the multiplexer MUX1, thereby lighting up the luminescent device $PX_{22}$ and discharging the parasite capacitor $C_2$ in the select switch $SC_2$, as indicated by the arrow marks in FIG. 4D. This way, no residual charge will be present in the select switch $SC_2$ during the next period that causes ghost images.

In the present invention, the first multiplexer MUX1 may further include a first delay circuit (not shown) disposed between its first input end $IN_1$ and its output end OUT for delaying the signal transmission from the first input end $IN_1$ to the output end OUT of the first multiplexer MUX1. The second multiplexer MUX2 may further include a second delay circuit (not shown) disposed between its first input end $IN_1$ and its output end OUT for delaying the signal transmission from the first input end $IN_1$ to the output end OUT of the second multiplexer MUX2. As depicted in FIG. 3, when the first address signal ADD1 switches from the high voltage level to the low voltage level at the time point t1, the first delay circuit can delay the signal transmission from the first input end $IN_1$ to the output end OUT of the first multiplexer MUX1 so that the first driving signal S1 fully switches from the low voltage level to the high voltage level at the time point t2, wherein the time point t1 occurs earlier than the time point t2. Similarly, when the second address signal ADD2 switches from the high voltage level to the low voltage level at the time point t3, the second delay circuit can delay the signal transmission from the first input end $IN_1$ to the output end OUT of the second multiplexer MUX2 so that the second driving signal S2 fully switches from the low voltage level to the high voltage level at the time point t4, wherein the time point t3 occurs earlier than the time point t4.

In conclusion, in the display device of the present invention, the coupling method of the luminescent device in the luminescent array and the two multiplexers in the column driver can charge the luminescent devices on a specific row while discharging the parasite capacitor in the switches associated with the luminescent devices on a prior row, thereby improving ghost images and the display quality of the display device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device which improves ghost images, comprising:

a luminescent array comprising M columns and N rows of luminescent devices, wherein:

among an $n^{th}$ row of luminescent devices in the N rows of luminescent devices, a cathode of each luminescent device is coupled to an $n^{th}$ word line;

among an $(n+1)^{th}$ row of luminescent devices in the N rows of luminescent devices, an anode of each luminescent device is coupled to an $(n+1)^{th}$ word line;

among an $m^{th}$ column of luminescent devices in the M columns of luminescent devices, an anode of a first luminescent device located on the $n^{th}$ row is coupled to a cathode of a second luminescent device located on the $(n+1)^{th}$ row;

M and N are integers larger than 1;

m is an integer between 1 and M;

n is an integer between 1 and N; and a column driver, comprising:

M select switches configured to control signal transmission paths between an input signal and the M columns of luminescent devices, wherein an $m^{th}$ select switch among the M select switches is configured to control a signal transmission path between the input signal and the $m^{th}$ column of luminescent devices;

a first multiplexer configured to provide a first driving signal according to a first address signal for supplying power to a parasite capacitor in the $m^{th}$ select switch and the first luminescent device during a first driving period; and a second multiplexer configured to provide a second driving signal according to a second address signal for supplying power to the second luminescent device and discharging the parasite capacitor in the $m^{th}$ select switch during a second diving period subsequent to the first driving period.

2. The display device of claim 1, wherein:

the first multiplexer includes:

a first input end coupled to the input signal;

a second input end coupled to a ground voltage;

a control end coupled to the first address signal; and an output end for outputting the first driving signal; and the second multiplexer includes:

a first input end coupled to the input signal;

a second input end coupled to the ground voltage;

a control end coupled to the second address signal; and an output end coupled to the $n^{th}$ word line and the $(n+1)^{th}$ word line.

3. The display device of claim 2, wherein:

the $m^{th}$ select switch includes:

a first input end coupled to the output end of the first multiplexer;

a second input end coupled to the anode of the first luminescent device and the cathode of the second luminescent device; and a control end coupled to a control signal.

4. The display device of claim 3, wherein:

the first address signal and the second address signal are periodic signals whose level switches between a first voltage level and a second voltage level;

the first multiplexer is configured to selectively output the input signal or the ground voltage based on the first address signal for providing the first driving signal;

the second multiplexer is configured to selectively output the input signal or the ground voltage based on the second address signal for providing the second driving signal;

the first voltage level is higher than the second voltage level; and the first address signal and the second address signal have opposite phases.

5. The display device of claim 4, wherein:

during the first driving period when the first address signal is at the second voltage level and the second address signal is at the first voltage level, the first multiplexer is configured to output the first driving signal having the first voltage level to the first end of the $m^{th}$ select switch, and the $n^{th}$ word line is coupled to the ground voltage via the second multiplexer; and during the second driving period when the first address signal is at the first voltage level and the second address signal is at the second voltage level, the second multiplexer is configured to output the second driving signal having the first voltage level to the $(n+1)^{th}$ word line, and the first end of the $m^{th}$ select switch is coupled to the ground voltage via the first multiplexer.

6. The display device of claim 5, wherein:

during the first driving period when the $m^{th}$ select switch is turned on by the control signal associated with the $m^{th}$ column of luminescent devices, the first driving signal having the first voltage level is transmitted to the anode of the first luminescent device via the $m^{th}$ select switch, and the cathode of the first luminescent device receives the second driving signal having the second voltage level via the $n^{th}$ word line, thereby supplying power to the parasite capacitance in the $m^{th}$ select switch and the first luminescent device; and during the second driving period when the $m^{th}$ select switch is turned on by the control signal associated with the $m^{th}$ column of luminescent devices, the second driving signal having the first voltage level is transmitted to the anode of the second luminescent device via the $(n+1)^{th}$ word line, and the cathode of the second luminescent device receives the first driving signal having the second voltage level via the $m^{th}$ select switch, thereby supplying power to the second luminescent device and discharging the parasite capacitance in the $m^{th}$ select switch.

7. The display device of claim 2, wherein:

the first multiplexer further includes a first delay circuit disposed between the first input end of the first multiplexer and the output end of the first multiplexer; and the second multiplexer further includes a second delay circuit disposed between the first input end of the second multiplexer and the output end of the second multiplexer.

8. The display device of claim 7, wherein:

at a first time point when the first address signal switches from the first voltage level to the second voltage level, the first delay circuit is configured to delay a signal transmission from the first input end of the first multiplexer to the output end of the first multiplexer, so that the first driving signal fully switches from the second voltage level to the first voltage level at a second time point; and at a third time point when the second address signal switches from the first voltage level to the second voltage level, the second delay circuit is configured to delay a signal transmission from the first input end of the second multiplexer to the output end of the second multiplexer, so that the second driving signal fully switches from the second voltage level to the first voltage level at a fourth time point.

9. The display device of claim 1, wherein the M columns and N rows of luminescent devices include a light emitting diode (LED), a mini LED or a micro LED.

10. A driving method of improving ghost images, comprising:

a first multiplexer in a display device outputting a first driving signal having a first voltage level based on a first address signal, turning on a select switch for transmitting the first driving signal to an anode of a first luminescent device in the display device, and a second multiplexer in the display device outputting a second driving signal having a second voltage level to a cathode of the first luminescent device based on a second address signal during a first driving period; and the second multiplexer outputting the second driving signal having the first voltage level to an anode of a second luminescent device in the display device based on the second address signal, the first multiplexer outputting the first driving signal having the second voltage level based on the first address signal, and turning on the select switch for transmitting the first driving signal to a cathode of the second luminescent device during a second driving period subsequent to the first driving period, wherein:

the first voltage level is higher than the second voltage level;

the display device further comprises M columns and N rows of luminescent devices arranged in a luminescent array;

among an $n^{th}$ row of luminescent devices in the N rows of luminescent devices, a cathode of each luminescent device is coupled to an $n^{th}$ word line;

among an $(n+1)^{th}$ row of luminescent devices in the N rows of luminescent devices, an anode of each luminescent device is coupled to an $(n+1)^{th}$ word line;

the first luminescent device is located on an $m^{th}$ column and the $n^{th}$ row among of the M columns and N rows of luminescent devices;

the second luminescent device is located on the $m^{th}$ column and an $(n+1)^{th}$ row among of the M columns and N rows of luminescent devices;

an anode of the first luminescent device is coupled to a cathode of the second luminescent device;

M and N are integers larger than 1;

m is an integer between 1 and M; and n is an integer between 1 and N.

11. The driving method claim 10, further comprising:

coupling a first input end of the first multiplexer to an input signal;

coupling a second input end of the first multiplexer to a ground voltage;

coupling a control end of the first multiplexer to the first address signal;

providing the first driving signal at the output end of the first multiplexer;

coupling a first input end of the second multiplexer to the input signal;

coupling a second input end of the second multiplexer to the ground voltage;

coupling a control end of the second multiplexer to the second address signal;

selectively coupling an output end of the second multiplexer to the $n^{th}$ word line or the $(n+1)^{th}$ word line.

12. The driving method of claim 11, further comprising:

coupling a first input end of the select switch to the output end of the first multiplexer;

coupling a second end of the select switch to the anode of the first luminescent device and the cathode of the second luminescent device; and coupling a control end of the select switch to a control signal.

13. The driving method of claim 12, further comprising:

providing the first address signal and the second address signal whose level periodically switches between the first voltage level and the second voltage level;

the first multiplexer selectively outputting the input signal or the ground voltage based on the first address signal for providing the first driving signal;

the second multiplexer selectively outputting the input signal or the ground voltage based on the second address signal for providing the second driving signal;

the first voltage level is higher than the second voltage level; and the first address signal and the second address signal have opposite phases.

14. The driving method of claim 13, further comprising:

the first multiplexer outputting the first driving signal having the first voltage level to the first end of the select switch and the second multiplexer outputting the second driving signal having the second voltage level to the $n^{th}$ word line during the first driving period when the first address signal is at the second voltage level and the second address signal is at the first voltage level; and the first multiplexer outputting the second driving signal having the second voltage level to the $(n+1)^{th}$ word line and the second multiplexer outputting the second driving signal having the first voltage level to the first end of the select switch during the second driving period when the first address signal is at the first voltage level and the second address signal is at the second voltage level.

15. The driving method of claim 14, further comprising:

transmitting the first driving signal having the first voltage level to the anode of the first luminescent device via the $m^{th}$ select switch and transmitting the second driving signal having the second voltage level to the cathode of the first luminescent device via the $n^{th}$ word line during the first driving period when the $m^{th}$ select switch is turned on by the control signal associated with the first luminescent device, thereby supplying power to the parasite capacitance in the select switch and the first luminescent device; and transmitting the second driving signal having the first voltage level to the anode of the second luminescent device via the $(n+1)^{th}$ word line and transmitting the first driving signal having the second voltage level to the cathode of the second luminescent device via the select switch during the second driving period when the select switch is turned on by the control signal associated with the second luminescent device, thereby supplying power to the second luminescent device and discharging the parasite capacitance in the select switch.

16. The driving method of claim 11, further comprising:

disposing a first delay circuit between the first input end of the first multiplexer and the output end of the first multiplexer; and disposing a second delay circuit between the first input end of the first multiplexer and the output end of the second multiplexer.

17. The driving method of claim 16, further comprising:

the first delay circuit delaying a signal transmission from the first input end of the first multiplexer to the output end of the first multiplexer at a first time point when the first address signal switches from the first voltage level to the second voltage level, so that the first driving signal fully switches from the second voltage level to the first voltage level at a second time point; and the second delay circuit delaying a signal transmission from the first input end of the second multiplexer to the output end of the second multiplexer at a third time point when the second address signal switches from the second voltage level to the first voltage level, so that the second driving signal fully switches from the second voltage level to the first voltage level at a fourth time point.

18. The driving method of claim 10, wherein the M columns and N rows of luminescent devices include an LED, a mini LED or a micro LED.

19. A driving circuit which improves ghost images when driving M columns and N rows of luminescent devices, wherein:

among an $n^{th}$ row of luminescent devices in the N rows of luminescent devices, a cathode of each luminescent device is coupled to an $n^{th}$ word line;

among an $(n+1)^{th}$ row of luminescent devices in the N rows of luminescent devices, an anode of each luminescent device is coupled to an $(n+1)^{th}$ word line;

among an $m^{th}$ column of luminescent devices in the M columns of luminescent devices, an anode of a first luminescent device located on the $n^{th}$ row is coupled to a cathode of a second luminescent device located on the $(n+1)^{th}$ row;

M and N are integers larger than 1;

m is an integer between 1 and M; and n is an integer between 1 and N;

the driving circuit comprising a column driver which includes:

M select switches configured to control signal transmission paths between an input signal and the M columns of luminescent devices, wherein an $m^{th}$ select switch among the M select switches is configured to control a signal transmission path between the input signal and the $m^{th}$ column of luminescent devices;

a first multiplexer configured to provide a first driving signal according to a first address signal for supplying power to a parasite capacitor in the $m^{th}$ select switch and the first luminescent device during a first driving period; and a second multiplexer configured to provide a second driving signal according to a second address signal for supplying power to the second luminescent device and discharging the parasite capacitor in the $m^{th}$ select switch during a second diving period subsequent to the first driving period.

20. The driving circuit of claim 19, wherein:

the first multiplexer includes:

a first input end coupled to the input signal;

a second input end coupled to a ground voltage;

a control end coupled to the first address signal; and an output end for outputting the first driving signal; and the second multiplexer includes:

a first input end coupled to the input signal;

a second input end coupled to the ground voltage;

a control end coupled to the second address signal; and an output end coupled to the $n^{th}$ word line and the $(n+1)^{th}$ word line.

* * * * *